US006921035B2

(12) United States Patent
Hohl

(10) Patent No.: US 6,921,035 B2
(45) Date of Patent: Jul. 26, 2005

(54) FUEL INJECTION VALVE

(75) Inventor: Guenther Hohl, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 258 days.

(21) Appl. No.: 10/275,793

(22) PCT Filed: Mar. 14, 2002

(86) PCT No.: PCT/DE02/00909

§ 371 (c)(1),
(2), (4) Date: Nov. 8, 2002

(87) PCT Pub. No.: WO02/073026

PCT Pub. Date: Sep. 19, 2002

(65) Prior Publication Data

US 2003/0168534 A1 Sep. 11, 2003

(30) Foreign Application Priority Data

Mar. 14, 2001 (DE) ..... 101 12 143

(51) Int. Cl.[7] ..... B05B 1/30

(52) U.S. Cl. ..... 239/585.1; 239/585.2; 239/585.3; 239/585.4; 239/585.5; 239/533.2; 239/533.3; 239/88

(58) Field of Search ..... 239/585.1–585.5, 239/533.2, 533.3, 533.7, 533.8, 533.9, 533.11, 88–93; 251/129.15, 129.21, 127

(56) References Cited

U.S. PATENT DOCUMENTS

| | | | | | |
|---|---|---|---|---|---|
| 3,797,835 | A | * | 3/1974 | Wehner | 277/614 |
| 4,432,555 | A | * | 2/1984 | Langley | 277/644 |
| 5,275,341 | A | * | 1/1994 | Romann et al. | 239/585.4 |
| 5,544,816 | A | * | 8/1996 | Nally et al. | 239/585.5 |
| 5,692,723 | A | * | 12/1997 | Baxter et al. | 251/129.21 |
| 6,427,666 | B1 | * | 8/2002 | Dallmann et al. | 123/467 |

FOREIGN PATENT DOCUMENTS

| | | |
|---|---|---|
| DE | 196 00 403 | 8/1996 |
| FR | 2 347 543 | 11/1977 |
| GB | 2 022 727 | 12/1979 |
| SU | 1 121 479 | 10/1984 |

OTHER PUBLICATIONS

Patent Abstracts of Japan vol. 2000, No. 11, Jan. 3, 2001 & JP 2000 220555 A (Isuzu Motors Ltd.), Aug. 8, 2000.
Patent Abstracts of Japan vol. 2000, No. 08, Oct. 6, 2000 & JP 2000 145595 A (Keihin Corp.), May 26, 2000.

* cited by examiner

*Primary Examiner*—Davis Hwu
(74) *Attorney, Agent, or Firm*—Kenyon & Kenyon

(57) ABSTRACT

A fuel injector, in particular for direct injection of fuel into the combustion chamber of a mixture-compressing, spark-ignited internal combustion engine, includes a valve housing formed by a nozzle body, as well as a sealing ring, which seals the fuel injector against a cylinder head of the engine.

11 Claims, 2 Drawing Sheets

FUEL INJECTION VALVE

FIELD OF THE INVENTION

The present invention relates to a fuel injector.

BACKGROUND INFORMATION

German Published Patent Application No. 196 00 403 describes an electromagnetic fuel injector including a suitable mounting structure to meet the requirements for the sealing effect, the thermal resistance, and the pressure resistance of an internal combustion engine having a cylinder injection system. The electromagnetic fuel injector may be mounted to a sealing of the area immediately adjacent to the cylinder, as well as to an area farther away therefrom. This may result in a first sealing sector having a first sealing ring which is configured as a corrugated underlying ring being arranged at a point close to the cylinder and between the fuel injector and the cylinder head. Furthermore, a second sealing sector having a second sealing ring, which is also configured as a corrugated underlying ring, is arranged at a point which is farther away from the cylinder than the first sealing sector.

A fuel injector described in German Published Patent Application No. 196 00 403 may include a complexity in manufacturing, as well as high manufacturing costs for the sealing rings due to the use of expensive materials such as silver-plated INCONEL.

Also, complex assembly may be associated with a high sealing effect, which may require mechanical forces during assembly such that damage to the components may result.

SUMMARY OF THE INVENTION

An exemplary fuel injector according to the present invention may include a sealing ring having a conical external contour, due to which the pressure forces associated with the assembly of the fuel injector may be reduced. The sealing ring may have a radial projection over the nozzle body, and the radial projection may increase over the axial length of the sealing ring in the downstream direction.

The sealing ring may have a circumferential groove, which, in connection with a ring formed in a recess provided for the sealing ring, may make an axial fixation of the sealing ring possible.

A cylindrical recess may be formed at the internal diameter of the sealing ring in the area of the greatest projection f, the recess imparting radial elasticity to the sealing ring, thereby reducing the required assembly forces.

A chamfer, formed on both the sealing ring and the cylinder head may facilitate the insertion of the fuel injector including the assembled sealing ring into a receiving bore of the cylinder head.

The formation of a gap between the nozzle body and the wall of the receiving bore in the cylinder head may facilitate a pressure-supported sealing effect during operation of the fuel injector.

DETAILED DESCRIPTION

Figure 1:
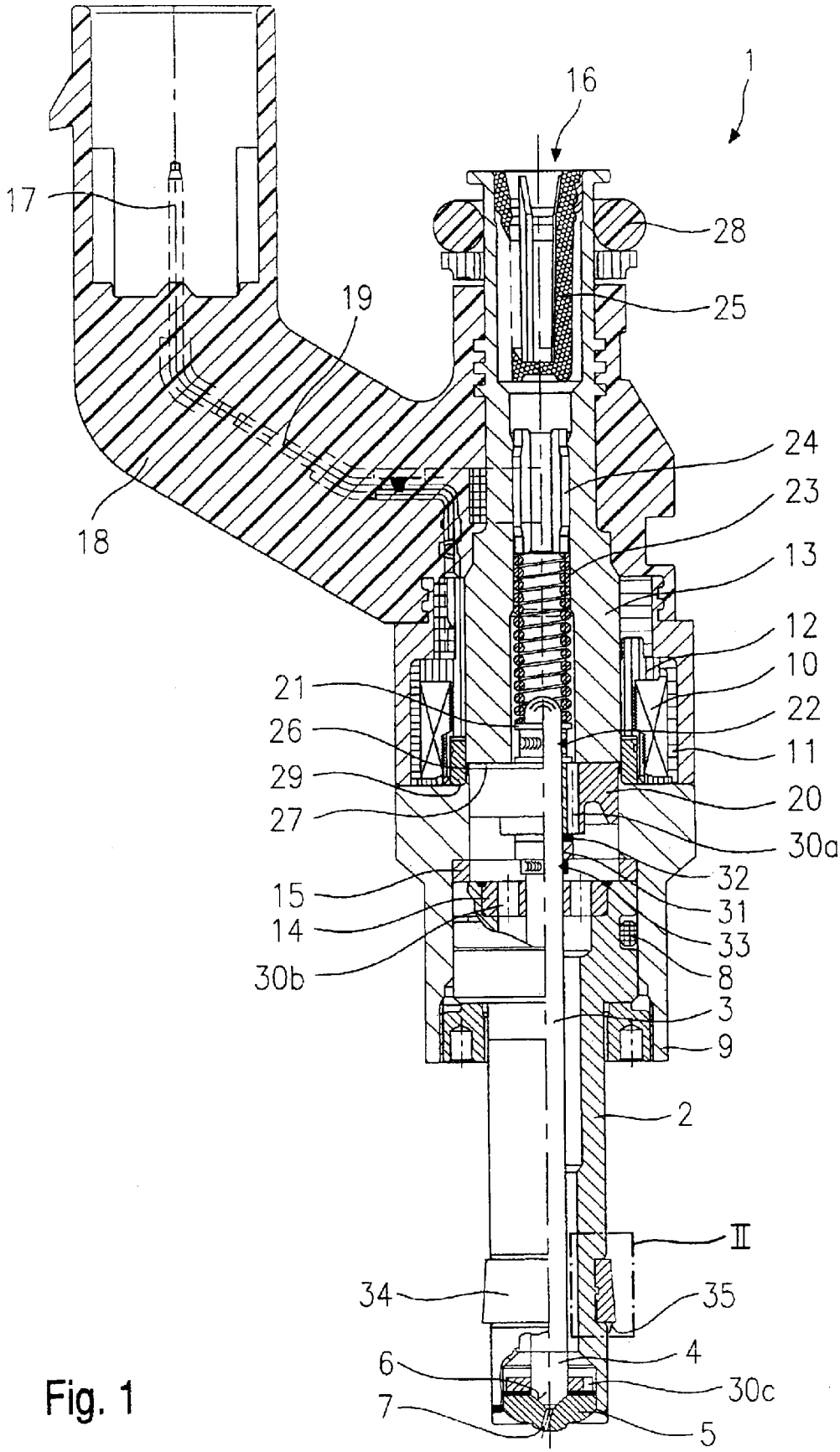
FIG. 1 shows a schematic section through an exemplary embodiment of a fuel injector according to the present invention in an overall view.

A fuel injector 1 is configured in the form of a fuel injector for fuel injection systems of mixture-compressing, spark-ignited internal combustion engines. Fuel injector 1 may be suitable for direct injection of fuel into a combustion chamber (not shown) of an internal combustion engine.

Fuel injector 1 includes a nozzle body 2, in which a valve needle 3 is arranged. Valve needle 3 is mechanically linked to valve-closure member 4, which cooperates with a valve seat surface 6 arranged on a valve seat body 5 to form a sealing seat. In the exemplary embodiment, fuel injector 1 represents an inwardly opening fuel injector 1 which has a spray-discharge orifice 7.

Nozzle body 2 is sealed by a seal 8 against an external pole 9 of a solenoid 10, as well as by a seal 34 against the cylinder head of the engine, not further illustrated in FIG. 1. In order to achieve a reliable sealing effect, sealing ring 34 may be made of a material, such as, for example, coated with Teflon®, or may be directly made of PTFE (Polytetrafluoroethylene). According to an exemplary embodiment of the present invention, sealing ring 34 has a conically contoured diameter, whereby projection 35 of sealing ring 34, rising above nozzle body 2, varies over its axial length. A detailed illustration of sealing ring 34 may be obtained from the description regarding FIG. 2.

Solenoid 10 is encapsulated in a coil housing 11 and wound on a field spool 12 which rests on an internal pole 13 of solenoid 10. Internal pole 13 and external pole 9 are separated from one another by a gap 26 and are supported by a connecting part 29. Solenoid 10 is excited by an electric current which is suppliable via a line 19 and an electric plug connection 17. Plug connection 17 is surrounded by a plastic sheathing 18, which may be extruded onto internal pole 13.

Valve needle 3 is guided in a disk-shaped valve needle guide 14. A matching adjusting disk 15 is used to adjust the valve lift. On the other side of adjusting disk 15 there is an armature 20, which is friction-locked via a first flange 21 to valve needle 3, which is connected to first flange 21 by a weld 22. A restoring spring 23 is supported by first flange 21. In the present exemplary configuration of fuel injector 1, restoring spring 23 is pre-stressed by a sleeve 24.

A second flange 31 which serves as the lower armature stop is arranged downstream from armature 20. The second flange is friction-locked to valve needle 3 by a weld 33. For damping the rebound of the anchor during closing of fuel injector 1, an elastic intermediate ring 32 is arranged between armature 20 and second flange 31.

Fuel channels 30*a* through 30*c* run in valve needle guide 14, armature 20, and on valve seat body 5. The fuel is supplied via a central fuel supply line 16 and is filtered through a filter element 25. Fuel injector 1 is sealed against a distribution line (not shown) by a seal 28.

In the resting state of fuel injector 1, first flange 21 at valve needle 3 is acted upon by restoring spring 23 against its lift direction in such a manner that valve-closure member 4 is held on valve seat 6 in a sealing contact. Armature 20 rests on intermediate ring 32 which is supported by second flange 31. When solenoid 10 is excited, it builds up a magnetic field, which moves armature 20 against the elastic force of restoring spring 23 in the lift direction. Armature 20 entrains first flange 21, which is welded to valve needle 3, and thus also valve needle 3 in the lift direction. Valve-closure member 4, which is mechanically linked to valve needle 3, lifts from valve seat surface 6, whereby the fuel, fed to spray-discharge orifice 7 via fuel channels 30*a* through 30*c*, is spray-discharged.

If the solenoid current is switched off, after the magnetic field has sufficiently decayed, armature 20 drops off internal pole 13 due to the pressure of restoring spring 23 on first flange 21, whereby valve needle 3 moves against the lift direction. This causes valve-closure member 4 to come to rest on valve seat surface 6 and fuel injector 1 is closed. Armature 20 comes to rest on the armature stop formed by second flange 31.

Figure 2:
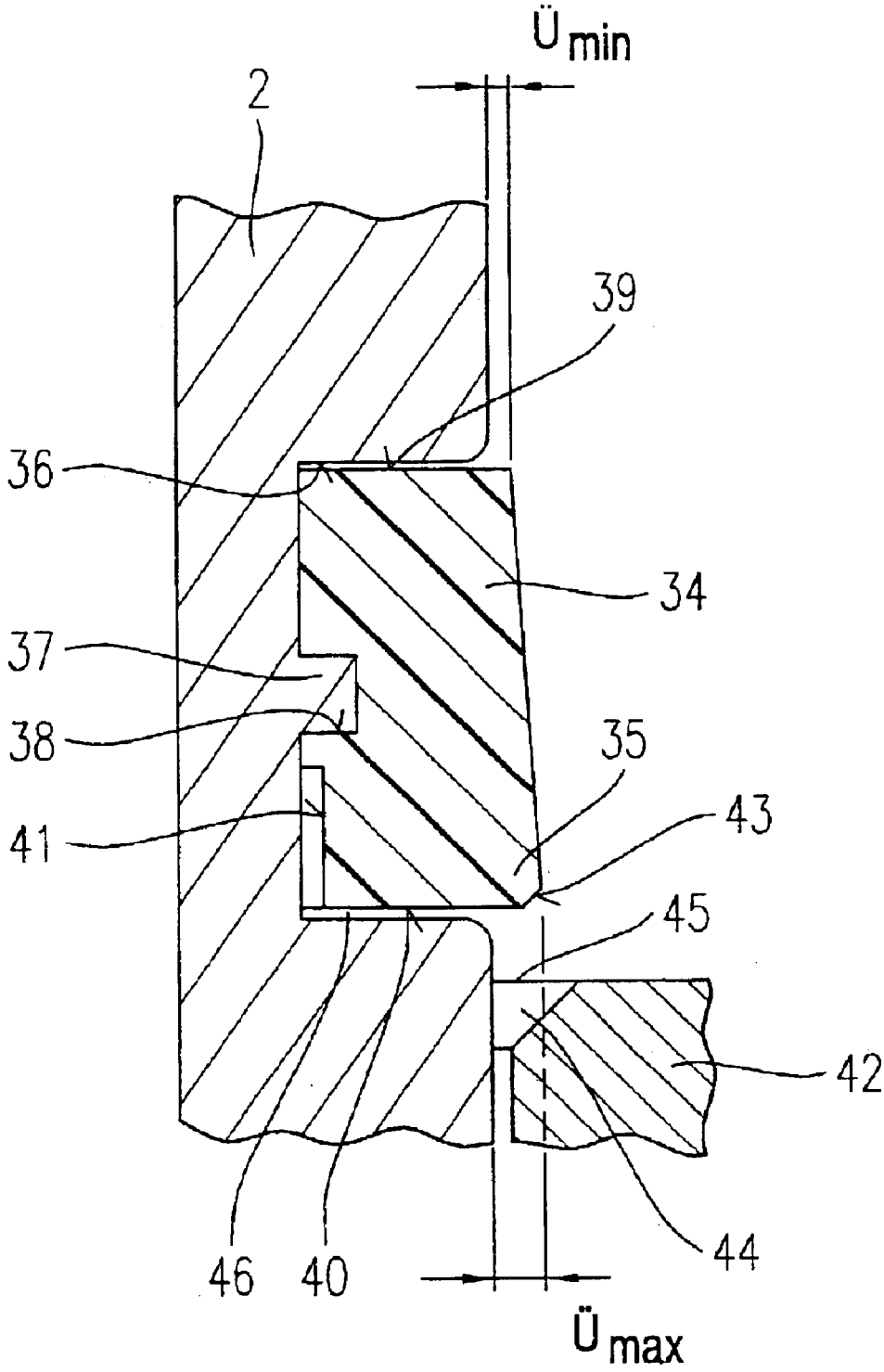
FIG. 2 shows a schematic detail from the fuel injector arranged according to the present invention in area II of FIG. 1.

FIG. 2 shows a partial section of the detail denoted with II in FIG. 1 of fuel injector 1 configured according to an exemplary embodiment of the present invention. Identical components are provided with identical reference symbols.

Sealing ring 34 is arranged in a groove-shaped circumferential recess 36 of nozzle body 2. To safeguard against shifting during assembly of fuel injector 1 as well as during operation, a ring 37 is provided, which is formed in recess 36 of nozzle body 2, extends beyond the groove base, and engages in a corresponding groove 38 of sealing ring 34.

According to an exemplary embodiment of the present invention, sealing ring 34 is conically contoured. This means, as already mentioned, that projection 35, rising radially over nozzle body 2, varies over the axial length of sealing ring 34. Projection 35 is minimal at an upstream front face 39 of sealing ring 34, while projection 35 is maximal at a downstream front face 40 of sealing ring 34. This is denoted in FIG. 2 with $\ddot{U}_{min}$ and $\ddot{U}_{max}$.

Furthermore, sealing ring 34 is provided with a cylindrical recess 41 downstream from ring 37, whereby sealing ring 34 is arranged in this area at a distance from the groove base of recess 36, so that recess 36 imparts a slight elasticity to sealing ring 34. This may be desirable for the assembly of sealing ring 34 in recess 36 of nozzle body 2, because the diameter of sealing ring 34 is enlarged in this area, and thus the force required for sliding sealing ring 34 onto nozzle body 2 may be smaller. The insertion into recess 36 may also be simplified.

The radial elasticity may also be desirable for the assembly of fuel injector 1 in a cylinder head 42 of the engine. If fuel injector 1 including sealing ring 34 is inserted into an appropriate receiving bore of cylinder head 42, then sealing ring 34 may be radially compressed due to cylindrical recess 41. Thus, the area of maximal projection 35 may be subsequently compressed. This may result in an easy insertability of fuel injector 1 into cylinder head 42.

In addition, the assembly is reinforced by a chamfer 43 on the downstream front face 40 of sealing ring 34 having maximal projection 35, the chamfer rounding off maximal projection 35 in this area. A similar effect may be achieved by an appropriate chamfer 44 at an edge 45 of the receiving bore of cylinder head 42.

The reliable sealing effect of sealing ring 34 configured according to an exemplary embodiment of the present invention may be provided by the radial pressure exerted on it. The combustion chamber pressure is greater downstream from sealing ring 34 than the ambient pressure on the upstream side of sealing ring 34; sealing ring 34 expands in the radial direction by the combustion chamber pressure via a gap 46 between downstream front face 40 and recess 36, the gap being connected to cylindrical recess 41, so that the sealing effect is reinforced during operation of fuel injector 1.

The present invention is not limited to the exemplary embodiment illustrated and is applicable to other cross section shapes of sealing rings 34, as well as to any configuration of fuel injectors 1, for example for fuel injectors 1 connected to a common rail system.

What is claimed is:

1. A fuel injector for direct injection of fuel, comprising:

a nozzle body to form a valve housing;

a sealing ring to seal the fuel injector against a cylinder head of an internal combustion engine, the sealing ring being conically contoured on an outside and having an external radius increasing in a downstream direction, the sealing ring further including a projection, protruding over the nozzle body, also increasing in the downstream direction.

2. The fuel injector of claim 1, wherein the fuel injector is arranged to inject fuel directly into a combustion chamber of a mixture-compressing, spark-ignited internal combustion engine.

3. The fuel injector of claim 1, wherein the projection is configured to be minimal on an upstream front face of the sealing ring and maximal at a downstream front face of the sealing ring.

4. The fuel injector of claim 1, wherein the nozzle body includes a first recess and the sealing ring is partially arranged in the recess.

5. The fuel injector of claim 4, wherein the sealing ring includes a groove and the first recess includes a protruding ring configured to engage in the groove so that the sealing ring is secured in an axial direction.

6. A fuel injector for direct injection of fuel, comprising:

a nozzle body to form a valve housing; and a sealing ring to seal the fuel injector against a cylinder head of an internal combustion engine, the sealing ring being conically contoured on an outside and having an external radius increasing in a downstream direction, the sealing ring further including a projection protruding over the nozzle body, also increasing in the downstream direction;

wherein the nozzle body includes a first recess and the sealing ring is partially arranged in the recess;

wherein the sealing ring includes a groove and the first recess includes a protruding ring configured to engage in the groove so that the sealing ring is secured in an axial direction; and wherein the sealing ring includes a cylindrical recess downstream from the groove on a radial internal diameter of the sealing ring.

7. The fuel injector of claim 6, wherein the sealing ring is arranged at a distance from the first recess in an area of the cylindrical recess.

8. The fuel injector of claim 6, further comprising:

a gap formed between a downstream front face and the first recess, and being connected to the cylindrical recess.

9. The fuel injector of claim 8, wherein the sealing ring is configured to be acted upon by a combustion chamber pressure via the gap and the cylindrical recess.

10. A fuel injector for direct injection of fuel, comprising:

a nozzle body to form a valve housing; and a sealing ring to seal the fuel injector against a cylinder head of an internal combustion engine, the sealing ring being conically contoured on an outside and having an external radius increasing in a downstream direction, the sealing ring further including a projection, protruding over the nozzle body, also increasing in the downstream direction;

wherein the projection is configured to be minimal on an upstream front face of the sealing ring and maximal at a downstream front face of the sealing ring; and wherein the sealing ring includes a chamfer in an area of the maximal projection.

11. A fuel injector for direct injection of fuel, comprising:

a nozzle body to form a valve housing;

a sealing ring to seal the fuel injector against a cylinder head of an internal combustion engine, the sealing ring being conically contoured on an outside and having an external radius increasing in a downstream direction, the sealing ring further including a projection, protruding over the nozzle body, also increasing in the downstream direction; and a chamfer arranged on the cylinder head in an area of an edge of a receiving bore for the fuel injector.

* * * * *

UNITED STATES PATENT AND TRADEMARK OFFICE

CERTIFICATE OF CORRECTION

PATENT NO. : 6,921,035 B2
DATED : July 26, 2005
INVENTOR(S) : Guenther Hohl

It is certified that error appears in the above-identified patent and that said Letters Patent is hereby corrected as shown below:

Column 1,
Lines 49-50, change "the greatest projection f," to -- the greatest projection $\ddot{U}_{max}$, --.

Signed and Sealed this

Thirteenth Day of December, 2005

JON W. DUDAS
*Director of the United States Patent and Trademark Office*